US005619748A

United States Patent [19]

Nelson et al.

[11] Patent Number: 5,619,748

[45] Date of Patent: Apr. 15, 1997

[54] BALLISTIC VEST

[75] Inventors: Jeff S. Nelson, Chino Hills, Calif.; Allen L. Price, Rising Sun, Md.

[73] Assignee: Safariland Ltd., Inc., Ontario, Calif.

[21] Appl. No.: 617,426

[22] Filed: Mar. 18, 1996

Related U.S. Application Data

[63] Continuation of Ser. No. 321,994, Oct. 12, 1994, abandoned, which is a continuation of Ser. No. 109,082, Aug. 19, 1993, abandoned, which is a continuation-in-part of Ser. No. 44,285, Apr. 7, 1993, abandoned.

[51] Int. Cl.[6] ..... F41H 1/02

[52] U.S. Cl. ..... 2/2.5

[58] Field of Search ..... 2/2.5, 2; 428/911

[56] References Cited

U.S. PATENT DOCUMENTS

| | | | |
|---|---|---|---|
| 3,582,988 | 6/1971 | Armellino | 2/2.5 |
| 3,924,038 | 12/1975 | McArdle et al. | 2/2.5 X |
| 4,403,012 | 9/1983 | Harpell et al. | 428/290 |
| 4,457,985 | 7/1984 | Harpell et al. | 428/224 |
| 4,501,856 | 2/1985 | Harpell et al. | 525/240 |
| 4,623,574 | 11/1986 | Harpell et al. | 428/113 |
| 4,650,710 | 3/1987 | Harpell et al. | 428/263 |
| 4,681,792 | 7/1987 | Harpell et al. | 428/102 |
| 4,879,165 | 11/1989 | Smith | 2/2.5 X |
| 4,989,266 | 2/1991 | Borgese et al. | 2/2.5 |
| 5,008,959 | 4/1991 | Coppage, Jr. et al. | 2/2.5 |
| 5,112,667 | 5/1992 | Li et al. | 428/113 |
| 5,185,195 | 2/1993 | Harpell et al. | 428/102 |
| 5,327,811 | 7/1994 | Price et al. | 89/36.05 |
| 5,395,671 | 3/1995 | Coppage et al. | 428/102 |

FOREIGN PATENT DOCUMENTS 2198628A 6/1988 United Kingdom .

WO87/03674 6/1987 WIPO .

*Primary Examiner*—Paul C. Lewis
*Attorney, Agent, or Firm*—Christie, Parker & Hale, LLP

[57] ABSTRACT

A ballistics vest of the soft body armor type comprises multiple overlying layers of a thin, flexible fabric made of woven plastic fibers secured together to form a soft, flexible front panel located on a strike side of the vest, and multiple overlying layers of a thin, flexible imperforate plastic sheet stacked behind the flexible front panel, on a body side of the vest. The flexible plastic sheets preferably comprise an array of plastic fibers embedded in a resinous matrix that forms the sheet material. The flexible front panel and the stack of flexible plastic sheets behind it have a combined areal weight not greater than about 1.20 lbs/ft$^2$ and have an NIJ Standard maximum backface of about 44 mm with a ballistics resistance that successfully prevents projectile penetration of the combined stacks of flexible layers according to NIJ Standard 0101.03 for Threat Level IIIA. The flexible fabric layers in the front panel are preferably quilted in a one-inch quilt pattern, and the fibers contained in the front panel and the rear panel are preferably extended chain polyethylene fibers. In one embodiment, the vest contains 20 layers of the woven fabric and 23 layers of the flexible plastic sheet material, with the areal density of the sheet material being 4.5 oz/yd$^2$ and the fibers in both front and rear panels having a fiber tenacity of at least about 35 gm/denier. Other embodiments comprise extremely lightweight ballistic vests including one meeting Threat Level II specifications and having an areal weight of less than one pound per square foot (psf); another vest meets Threat Level IIA specifications with an areal weight below 0.9 psf.

25 Claims, 3 Drawing Sheets

BALLISTIC VEST

CROSS REFERENCE

This is continuation of application Ser. No. 08/321,994, filed Oct. 12, 1994 now abandoned which is a continuation of application Ser. No. 08/109,082, filed Aug. 19, 1993 now abandoned which is a continuation-in-part of application Ser. No. 08/044,285, filed Apr. 7, 1993 now abandoned.

FIELD OF THE INVENTION

This invention relates to protective vests, and more particularly, to body armor commonly known as a ballistic vest.

BACKGROUND OF THE INVENTION

Ballistic vests have saved the lives of many law enforcement officers in recent years. As a result, law enforcement agencies have made it mandatory for their officers to wear a ballistic vest while on duty.

Ballistic vests have been available in recent years as a protective panel having overlying layers of a fabric made from woven high tensile strength plastic fibers. Woven fabrics made from an aramid fiber known as KELVAR, for example, have been used successfully in ballistic vests because of the high energy absorption properties of the fabric material. The material is also reasonably light in weight and flexible, which provides improved comfort when compared with previous vests which were made of metal and were therefore heavier and more rigid. The comfort of a ballistic vest is extremely important, especially to law enforcement officers, because of the heat build-up that occurs from wearing a heavy and inflexible vest for the long hours an officer is on duty. Resistance to projectile penetration is a principal factor in designing a ballistic vest; and added protective layers can offer greater protection against projectiles having the higher threat levels, but added protective layers also add undesired weight and inflexibility of the vest.

In addition to woven KEVLAR fabric layers, ballistic vests have been made from other high strength plastic fibers and composites to reduce weight and improve flexibility of the vest. However, ballistic vests using the lighter, more flexible materials also must offer the required minimum levels of protection against penetration by different types of projectiles.

Ballistic vests are regularly certified by subjecting them to ballistics testing to measure their ability to protect against different projectiles fired from different types of weapons at various angles. One ballistic test commonly used in the industry is the National Institution of Justice (NIJ) Standard 0101.03 Threat Level IIIA, which, in general terms, is a high performance standard requiring that the ballistic vest prevent penetration of specified .44 Magnum and 9 mm rounds fired at a velocity of at least 1400 ft/sec. In addition to preventing such projectile penetration, "backface deformation" also is a required test factor in the NIJ Standard 0101.03 Threat Level IIIA certification test. Backface deformation measures the trauma level experienced by a projectile that does not penetrate the test panel. According to this test, the maximum allowable backface signature (bfs) containment for soft body armor requires a maximum allowable bfs of 44 mm for .44 Magnum and 9 mm rounds.

There is a need to provide a ballistic vest that is reasonably light in weight, is highly flexible and comfortable, and is also capable of meeting the high performance projectile specifications of NIJ Threat Level IIIA. Providing such a vest at a reasonably low cost for the comparable high performance level also is a desirable objective.

There are other instances where lighter weight vests are more desirable even though they may not meet the Threat Level IIIA standards. Here the challenge is to produce a lightweight vest capable of meeting the certification standards of NIJ Threat Levels II and IIA. An extremely lightweight vest with an areal weight less than one pound per square foot that meets Level II and IIA standards is desirable.

SUMMARY OF THE INVENTION

The present invention provides a ballistic vest of the soft body armor type comprising a plurality of overlying first flexible layers arranged in a stack on a strike side of the vest, and a plurality of overlying second flexible layers arranged in a stack on a body side of the vest. Each first flexible layer comprises a thin, flexible, woven fabric layer made of high tensile strength polymeric fibers. The individual woven fabric layers are secured to each other as a unit to form a soft, flexible woven fabric front panel for the vest. Each second flexible layer comprises a thin, flexible imperforate fiber-reinforced plastic sheet comprising an array of plastic fibers embedded in a thermoplastic resinous matrix that forms each film sheet. The second layers overlie each other substantially without attachment to one another and as a combination are referred to as a rear panel of the vest. The stacks of first and second flexible layers are provided in a combination having anThese and areal weight not greater than about 1.20 lbs/ft$^2$, and more preferably about 1.16 lbs/ft$^2$, with an NIJ Standard maximum backface of not more than about 44 mm, and a ballistic resistance that prevents projectile penetration of the combined stacks of first and second flexible layers according to NIJ Standard 0101.03 Threat Level IIIA test specifications.

In a preferred form of the invention, the fibers contained in the first and second layers comprise extended chain polyethylene fibers having a fiber tenacity of at least about 30 gm/denier, more preferably 35 gm/denier. The modulus of the fibers contained in the first layer is about 1000 gm/denier, more preferably 1200 gm/denier. In a preferred embodiment of the invention, the stacks of first and second layers can be reduced to a combination of about 20 of the first layers and about 23 of the second layers, while meeting the NIJ level IIIA standards. In one embodiment, this high performance is achieved with the first and second flexible layers having a combined areal weight not greater than about 1.16 lbs/ft$^2$.

The result of the invention is a ballistic vest that is reasonably light in weight, highly flexible and comfortable, while providing high performance Threat Level IIIA resistance to ballistic penetration and backface deformation. This combination of properties is in addition to the reasonably low cost of the vest for the high performance level achieved.

In other embodiments of the invention, extremely lightweight ballistic vests are produced that meet NIJ Standard Threat Level II and IIA test specifications, while having an areal weight of less than about one pound per square root.

These and other aspects of the invention will be more fully understood by referring to the following detailed description and the accompanying drawings.

DETAILED DESCRIPTION

Figure 1:
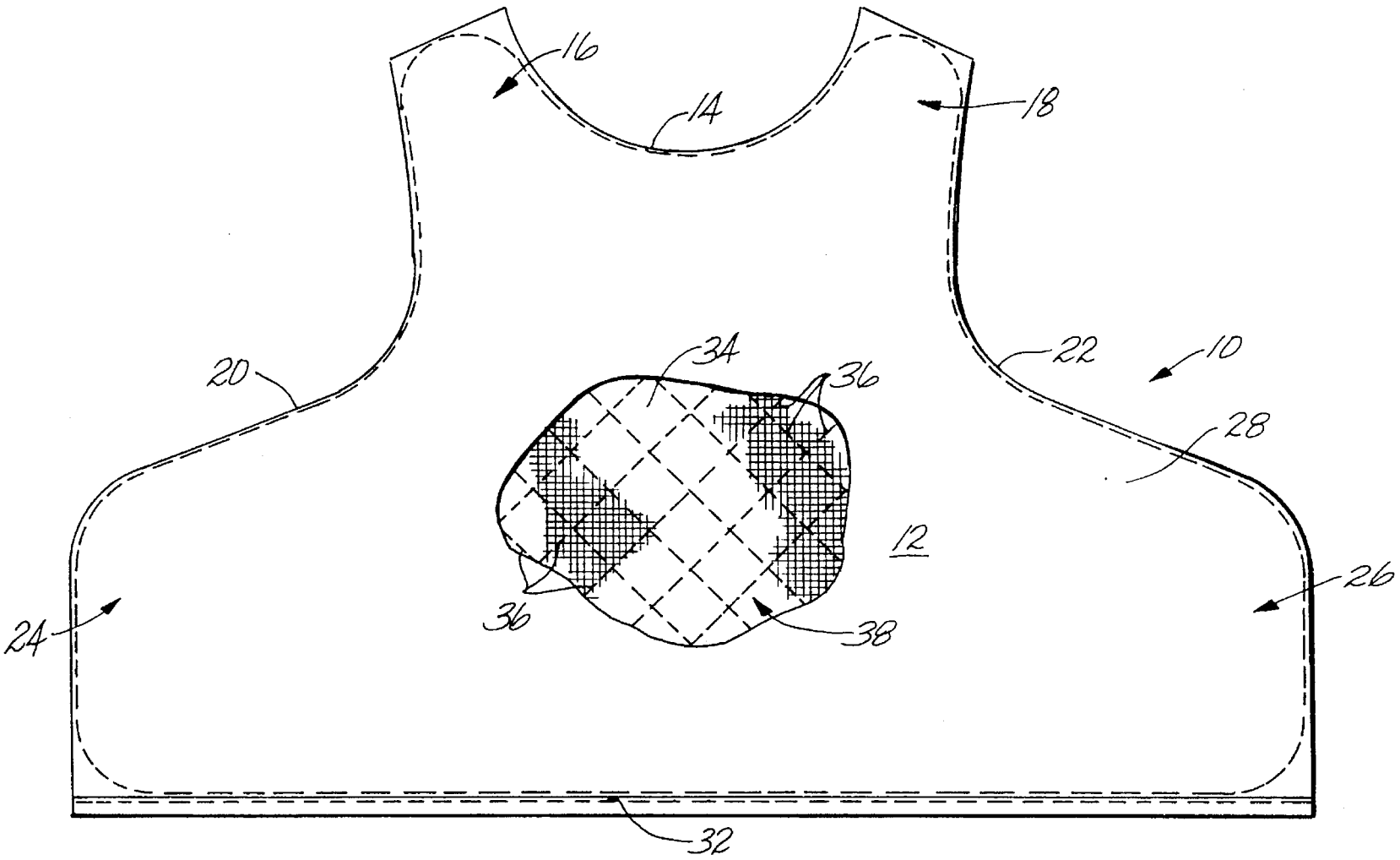
FIG. 1 is a front elevational view, partly broken away, showing a ballistic resistant composite panel used in a ballistic vest according to principles of this invention.

FIG. 1 illustrates a composite front ballistic panel 10 for a ballistic vest of the soft body armor type commonly worn by law enforcement officers. The composite front ballistic panel 10 provides a protective front section of the vest that overlies the chest region of the user. A separate rear protective region of the vest (not shown) overlies the back of the user. The composite front panel only is depicted in the drawings since the protective back section of the vest has a composite construction substantially identical to the front section. Therefore, the description of the composite front panel to follow will suffice for the rear panel used in the ballistic vest.

The front and rear composite protective panels are preferably carried in a vest structure which is well known in the art. The vest includes front and rear carriers for the front and rear ballistic panels, with shoulder straps and waist straps for securing the vest to the upper torso of the user. A ballistic vest with front and rear carriers that can be used for carrying the front and rear ballistic panels of this invention is described, e.g., in U.S. Pat. No. 4,697,285, which is assigned to the assignee of this application and incorporated herein by this reference.

Referring again to FIG. 1, the composite front ballistic panel 10 is generally configured to include a main body portion 12 that covers the chest region of the user, a recessed upper scoop neck region 14 for fitting under the neck, right and left upwardly projecting shoulder regions 16 and 18 for covering the right and left shoulders, recessed right and left arm regions 20 and 22 for fitting under the right and left arms of the user, and right and left side regions 24 and 26 for extending along the sides of the user when the panel is placed in a front carrier of the vest and worn over the chest.

Figure 2:
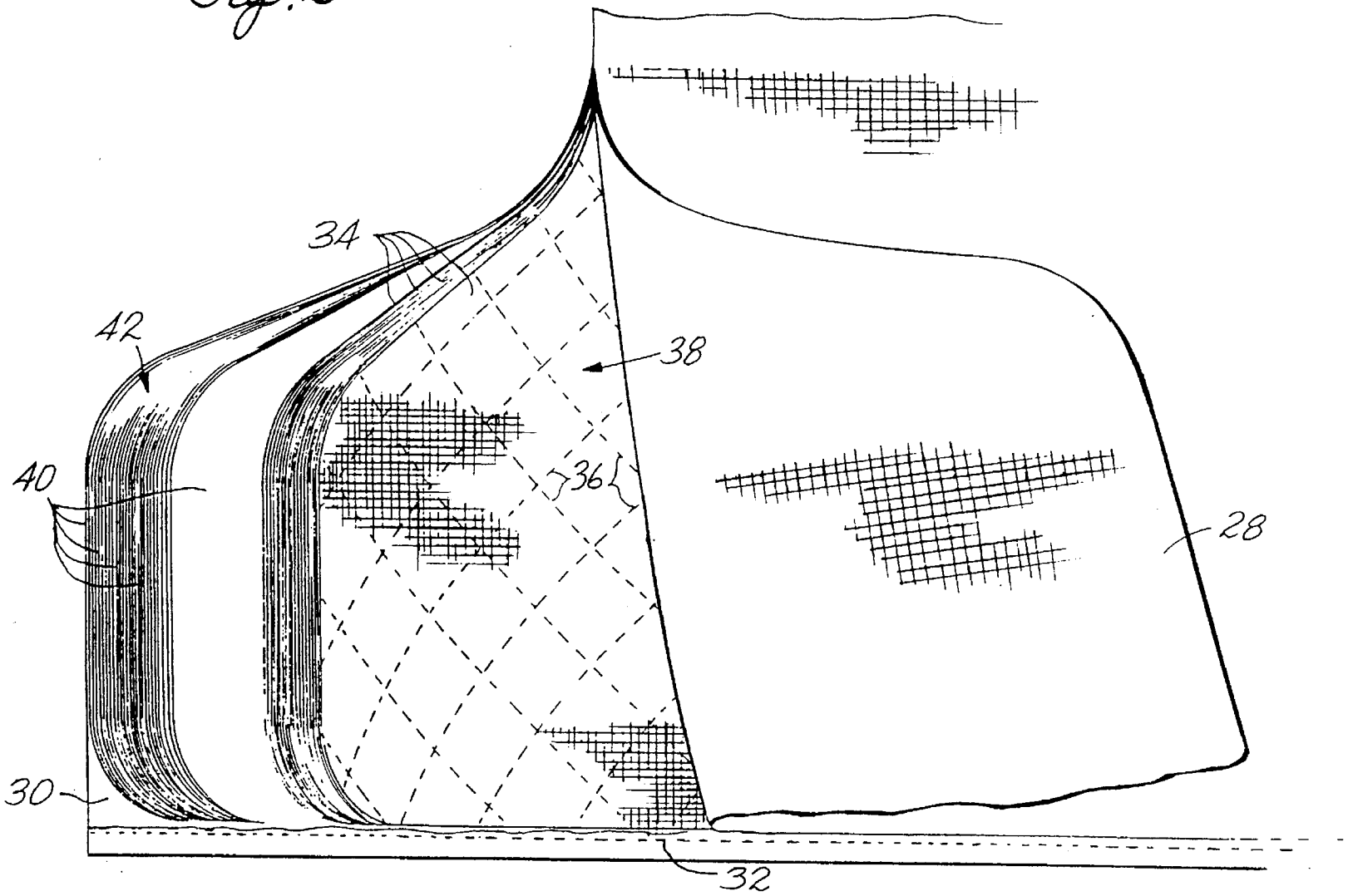
FIG. 2 is fragmentary perspective view, partly broken away, showing internal components of the ballistic resistant panel.
Figure 3:
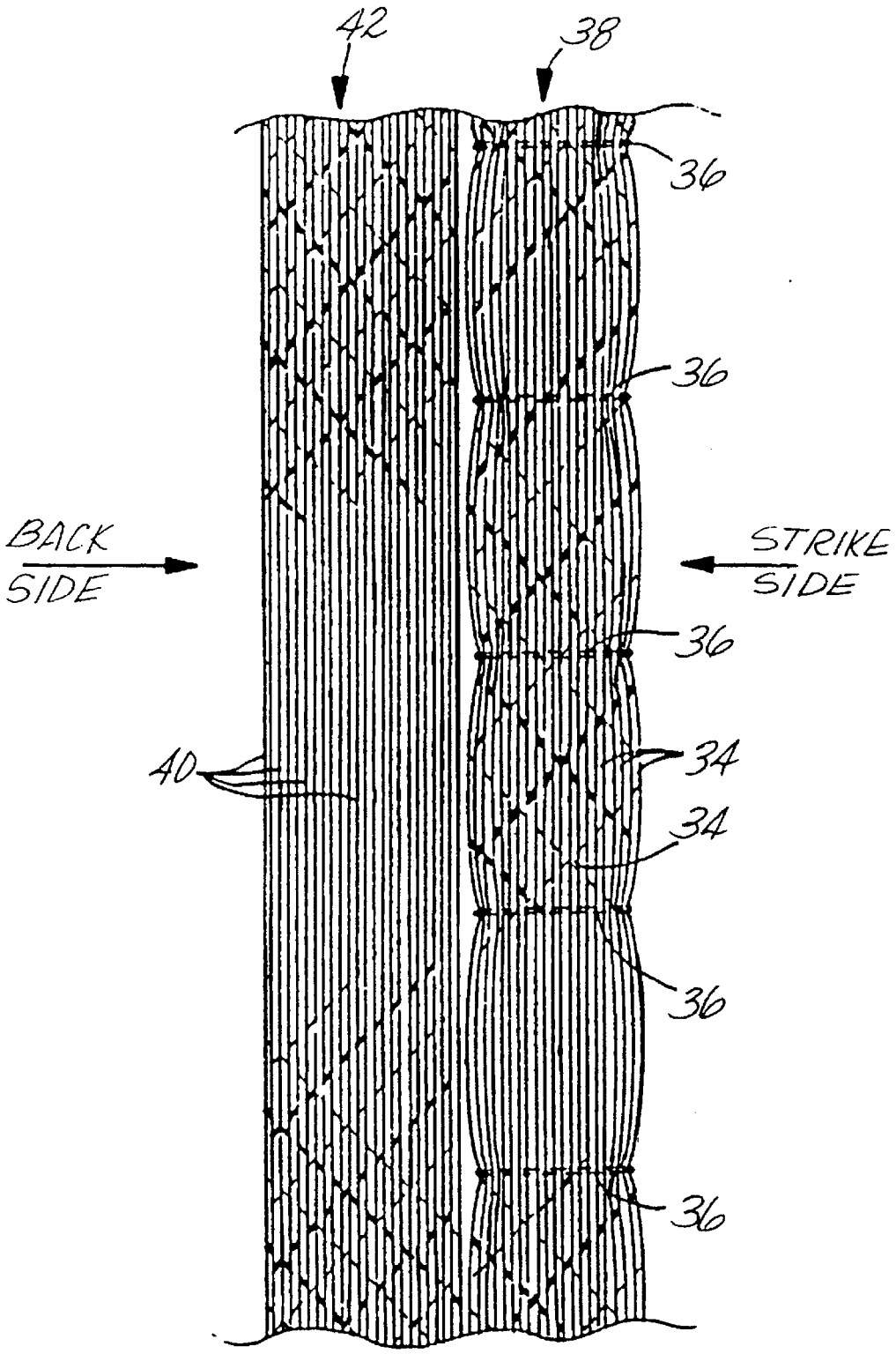
FIG. 3 is a schematic cross sectional, view showing individual layers of a flexible woven fabric front panel and a stack of thin, flexible fiber-reinforced plastic resin sheets forming a rear panel of the ballistic vest.

Referring to FIGS. 1 and 2, the composite front ballistic panel 10 includes an outer casing 28 made of front and rear sheets of an imperforate flexible waterproof fabric, such as ripstop nylon. The front sheet of the casing is shown at 28 in FIG. 1 and the rear sheet is shown at 30 in FIG. 2. The flexible front and rear sheets of the casing are secured together around the perimeter of the front panel 10 by stitching, such as the stitching shown at 32 in FIG. 1, which forms a bottom hem for the casing.

The front ballistic panel 10 further includes a plurality of overlying first flexible layers 34 arranged in a stack on a strike (front) side of the front panel 10. Each first flexible layer comprises thin plastic fibers forming a thin, flexible woven fabric layer. The individual woven fabric layers are secured to each other by quilt stitching 36 to form a soft, flexible, woven fabric front panel section 38 of unitary structure.

The composite front ballistic panel 10 also includes a plurality of overlying second flexible layers 40 arranged in a stack on a body (rear) side of the front panel 10. Each second flexible layer comprises a thin, flexible imperforate plastic sheet comprising high tensile strength plastic fibers embedded in a resinous matrix to form each thin, flexible plastic sheet. The first and second layers 34 and 40 are all cut to the same size and shape and overlie one another in layers parallel to one another. FIG. 2 shows a cut-away view of the front face 28 of the outer casing to reveal the stacks of first and second layers of the composite front ballistic panel 10. The second layers 40 are stacked behind the front panel section 38 so they are free-floating, i.e., they are freely movable relative to one another within the casing without being laminated to each other or otherwise bonded to one another in a face-to-face relation. Thus, the individual second layers 40 are free floating within an area encompassing most of the surface area occupied by the layers that comprise the front ballistic panel 10. In the present invention, although the second layers are individually free floating and movable relative to each other, they are stacked together to form in the aggregate what is referred to herein as a rear panel section 42 of the composite front ballistic panel 10.

The first flexible layers 34 of the front ballistic panel 10 will now be described. Each first layer 34 preferably comprises a flexible fabric made of woven high strength polymeric fibers with exhibit useful ballistic resistance in the woven form of the fabric. The preferred fabric is a plain woven fabric made of uncoated extended chain polyethylene fibers. The term "fiber" is defined herein as an elongated monofilament body of essentially uniform diameter with its long dimension substantially greater than the width or thickness of the fiber. In one embodiment of the invention, the extended chain polyethylene fibers are the high strength ballistic resistant fibers made of ultra high molecular weight highly oriented polyethylene fibers as described in U.S. Pat. No. 4,681,792, assigned to Allied Signal and incorporated herein by this reference. The individual extended chain polyethylene fibers are preferably 375 denier fibers. The fibers contained in the fabric have a fiber tenacity of at least about 30 grams/denier nominal, and more preferably about 35 grams/denier nominal. The tensile modulus of the fibers, as measured on an Instron tensile machine, is at least about 1,000 grams/denier, and more preferably about 1,200 grams/denier. The breaking strength of the fibers is at least about 25 pounds and more preferably about 29 pounds nominal. The dry thickness of the woven fabric layer is about 9 mils. The total fiber areal density of the fabric does not exceed about 3.4 oz/yd$^2$ and more preferably about 3.2 oz/yd$^2$. The fabric is constructed in a plain weave with 32 ends per inch in the ward direction and 32 ends per inch in the fill direction. The yarn is air entangled. The preferred woven fabric is available under the designation SPECTRA 1000 from Allied Signal. The woven fabric layers are quilt stitched, preferably on approximately one inch centers, to form the unitary flexible front panel section 38.

Although the first layer is made from a woven fabric comprised of the extended chain polyethylene fibers described above, the results of the invention also can be achieved with other similar high strength ballistic-resistant polymeric fibers such as aramid fiber, especially KEVLAR fiber; nylon fiber; polyolefin fiber such as polypropylene; and polyvinyl alcohol fiber, as described for example in U.S. Pat. No. 4,681,792, incorporated herein by reference.

The second flexible layers 40 that comprise the rear panel section 42 of the front ballistic panel 10 preferably are made of thin, flexible fiber-reinforced plastic film sheets. The film sheets are reinforced with an array of high tensile strength ballistic-resistant fibers embedded in a thermoplastic resinous matrix film. The preferred reinforcing fibers in the second layer are the extended chain ultra high molecular weight polyethylene fibers described above. These fibers are preferably arranged in a pattern in which the long fibers extend in a generally common plane at right angles to each other reasonably uniformly across the length and width of the film sheet. The preferred fiber-reinforced thermoplastic sheet is available under the designation SPECTRA SHIELD manufactured by Allied Signal, using a proprietary unidirectional fiber/resin process in which the fibers comprise the SPECTRA 1000 fibers described previously. The preferred SPECTRA SHIELD material has an areal density of 0.970 grams per $cm^2$; the resinous matrix is made from a proprietary thermoplastic elastomer having an elongation of about 4% maximum and the areal density of the material is about 4.5 $oz/yd^2$.

In one embodiment of the invention, the front panel section 38 consists of approximately 20 layers of the woven SPECTRA 1000 fabric, and the rear panel section 42 consists of approximately 23 layers of the Spectra Shield plastic sheets. The SPECTRA 1000 fabric layers are attached to the SPECTRA SHIELD layers by a single one inch long vertical stitch at the lowest point on the scoop neck region 14 of the composite ballistic panel. The stitching penetrates and joins all 43 layers of the panel. There are no other stitches through the layers of the SPECTRA SHIELD material.

The areal weight of the complete ballistic sandwich does not exceed about 1.20 pounds per square foot, more preferably about 1.16 pounds per square foot. An objective in designing body armor for use by law enforcement officers is to equip the officer with body armor that will be worn consistently day after day with a reasonably good comfort level produced by the light weight and flexibility of the composite vest material. There is a direct correlation between areal weight (weight of a 12"×12" section of the ballistic sandwich) of a vest and its comfort level. In the present invention, one objective was to (1) produce a ballistic sandwich having an areal weight not more than about 1.20 pounds per square foot and, more preferably, not more than about 1.16 pounds per square foot, while (2) achieving resistance to projectile penetration that meets NIJ Standard 0101.03 Certification Testing for Threat Level IIIA for .44 Magnum 240 Grain SWC Gas Check and 9 mm 124 Grain FMJ projectiles fired at a velocity of at least 1400 feet per second (fps), and while (3) achieving backface deformation test standards under NIJ Standard 103.03 Level IIIA having a maximum allowable bfs of 44 mm for .44 Magnum and 9 mm rounds.

EXAMPLE 1

An initial objective was to produce a ballistic vest having possible Level IIIA performance at an areal weight of 1.06 psf. The starting point was a 375 denier fabric made of extended chain polyethylene fibers in which the fabric had a plain 32×32 weave pattern and a fabric weight of 3.5 $oz/yd^2$. A composite ballistic panel was made from overlying layers of the SPECTRA SHIELD film sheets on the strike face and the woven 375 denier fabric on the body side. The fabric layers were quilt stitched, and the composite ballistic panel comprised 22 layers of the SPECTRA SHIELD sheeting and 17 layers of the 375 denier woven fabric; the areal weight was 1.06 psf. A comparison of this panel structure was made with both 1.0-inch and a 1.5-inch quilt stitching patterns in the fabric layers. Regression curve analysis and V-50 tests were performed, yielding poor results. The testing was discontinued on the 1.0-inch quilted fabric embodiment because penetrations were experienced with the .44 Magnum in the NIJ velocity for Level IIIA performance at 1400+50 fps. Penetrations were experienced with both the .44 Magnum and 9 mm rounds on the 1.5-inch quilt stitched fabric layer embodiment.

EXAMPLE 2

In order to improve performance, the number of layers (and therefore the areal weight) of the composite panel structure were increased to 21 layers of SPECTRA SHIELD on the strike side and 20 layers of the fabric of Example 1 on the rear side of the composite front panel. The total areal weight was 1.10 psf. Regression curve analysis and V-50 testing were conducted, comparing the 1.0-inch quilt pattern to the 1.5-inch quilt pattern used in the fabric portion of the composite panel. In the regression curve portion of the testing the 1.0-inch quilt pattern performed well, but the 1.5-inch quilt pattern had two penetrations with .44 Magnum rounds in the NIJ IIIA velocity ranges 1424 and 1407. The V-50 portions of the test also indicated better performance with the 1.0 inch quilt pattern as follows:

| | | V-50 Results | | | |
|---|---|---|---|---|---|
| Proj. | Sample | Conditioning | V-50 (ft/sec) | High Partial[1] | Low Complete[2] |
| .44 Mag | 1" D | Dry | 1579 | 1592 | 1576 |
| .44 Mag | 1" E | Wet | 1521 | 1532 | 1502 |
| 9 mm | 1" F | Wet | 1718 | 1743 | 1662 |
| 9 mm | 1" G | Dry | 1629 | 1674 | 1610 |
| .44 Mag | 1.5" D | Wet | 1540 | 1556 | 1516 |
| .44 Mag | 1.5" E | Dry | 1559 | 1552 | 1552 |
| 9 mm | 1.5" F | Wet | 1654 | 1676 | 1618 |
| 9 mm | 1.5" G | Dry | 1693 | 1710 | 1668 |

[1]Partial penetration, fastest bullet that did not penetrate.
[2]Lowest velocity at penetration.

Although penetration tests were reasonably successful, backface deformation problems were experienced. A .44 Magnum round produced a bfs of 45 mm and 56 mm. (The NIJ Standard allows for a maximum backface of 44 mm.) As a result, experiments were conducted with different stitch patterns in the quilted fabric rear panel of the ballistic panel structure. In all tests of various stitch patterns, the same result occurred: high backface exceeding NIJ specifications. It was determined that there was a one in six chance that a .44 Magnum round would penetrate all of the Spectra Shield layers and stop in the fabric. When this happened the backface deformation was too high. It was also determined that the high backface deformation occurred 75% of the time on the first impact.

EXAMPLE 3

Two layers of the SPECTRA SHIELD material were added to the test panel of Example 2 and all stitching was eliminated, except for the quilt stitch in the fabric layers that formed the rear section of the composite ballistic test panel. With the addition of the two layers of SPECTRA SHIELD material, the areal weight increased to 1.16 psf. The resulting test panel was submitted for certification testing for NIJ level IIIA in which the 1.0-inch quilt pattern stitching was used in the rear fabric layers. The resulting panel failed because the .44 Magnum penetrated the spectra shield stopping in the fabric causing high backface and failure, and maximum backface deformation was unacceptably high. Test results were as follows:

Regression Curve

| Proj. | Velocity | Backface Avg. | Backface Max. | Penetration # | Penetration % |
|---|---|---|---|---|---|
| .44 Mag | 1400 + 50 | 38 | 47 | 0 | 0 |
| .44 Mag | 1450 + 50 | 45 | 61 | 2 | 12.5 |
| .44 Mag | 1500 + 50 | 59.5 | 70 | 3 | 19.5 |
| 9 mm | 1400 + 50 | 40.4 | 44 | 0 | 0 |
| 9 mm | 1450 + 50 | 40 | 50 | 0 | 0 |
| 9 mm | 1500 + 50 | 39 | 44 | 2 | 12.5 |

Abbreviated NIJ & Certification

| Proj. | Velocity Max. | Velocity Min. | Backface Avg. | Backface Max. | Penetration # | Penetration % |
|---|---|---|---|---|---|---|
| .44 Mag | 1470 | 1403 | 48.3 | 58 | 0 | 0 |
| 9 mm | 1461 | 1406 | 30 | 31 | 0 | 0 |

V-50

| Proj. | V-50 | High Partial | Low Complete |
|---|---|---|---|
| .44 Mag | 1526 | 1552 | 1520 |
| .44 Mag | 1538 | 1548 | 1516 |
| .44 Mag | 1606 | 1624 | 1610 |
| | Avg. 1557 | Max. 1624 | Min. 1516 |
| 9 mm | 1748 | 1806 | 1722 |

The test results showed penetrations at 1500+50 ft/sec, but these velocities exceed maximum acceptable test level velocities of 1400 to 1450 ft/sec.

EXAMPLE 4

The positions of the SPECTRA SHIELD layers and the quilted fabric layers were reversed in the next test panel. A test panel was subjected to NIJ level IIIA testing with 20 layers of the one-inch quilted Spectra 1000 fabric on the strike side of the panel and 23 layers of the SPECTRA SHIELD material on the rear side of the panel. The results improved, with the backface being reduced from 56 mm and 58 mm to 42 mm and 44 mm, respectively.

It was then decided to conduct regression curve testing on the same test panel. A 1.0-inch dart stitch was added to the lowest portion of the neck region to connect all layers to prevent separation during constant wear by an officer. Regression curves and V-50 testing were conducted on this panel, as well as an otherwise identical panel having no quilt stitching. A penetration with 9 mm at 1448 ft/sec occurred in the panel with no quilting. The test panel having the 1.0-inch quilt pattern resulted in a highly successful increase in penetration performance. Ballistic penetration tests showed an increase in V-50 performance of about 6% for the .44 Magnum rounds. In addition, backface performance improved remarkably. Another phenomenon was noticed. The more this panel was impacted, the lower the resulting backface measurement. The panel was then broken in by a rolling method and reshot for regression curve analysis. Backface improved another 10%. The same test panel was then subjected to abbreviated NIJ level IIIA testing and all performance tests were passed. The results were as follows:

Regression Curve

| Proj. | Velocity | Backface Avg. | Backface Max. | Penetration # | Penetration % |
|---|---|---|---|---|---|
| .44 Mag | 1400 + 50 | 30.6 | 36 | 0 | 0 |
| .44 Mag | 1450 + 50 | 37 | 46 | 0 | 0 |
| .44 Mag | 1500 + 50 | 40.5 | 54 | 1 | 6.25 |
| 9 mm | 1400 + 50 | 27.4 | 29 | 0 | 0 |
| 9 mm | 1450 + 50 | 26.4 | 31 | 0 | 0 |
| 9 mm | 1500 + 50 | 29 | 34 | 0 | 0 |

Abbreviated NIJ & Certification

| Proj. | Velocity Max. | Velocity Min. | Backface Avg. | Backface Max. | Penetration # | Penetration % |
|---|---|---|---|---|---|---|
| .44 Mag | 1461 | 1401 | 37.3 | 42 | 0 | 0 |
| 9 mm | 1462 | 1418 | 28.5 | 33 | 0 | 0 |

V-50

| Proj. | V-50 | High Partial | Low Complete |
|---|---|---|---|
| .44 Mag | 1637 | 1648 | 1634 |
| .44 Mag | 1657 | 1673 | 1620 |
| .44 Mag | 1658 | 1670 | 1653 |
| .44 Mag | 1628 | 1646 | 1618 |
| .44 Mag | 1651 | 1715 | 1598 |
| | Avg. 1646 | Max. 1715 | Min. 1598 |
| 9 mm | 1677 | 1738 | 1667 |
| 9 mm | 1653 | 1664 | 1620 |
| 9 mm | 1674 | 1714 | 1625 |
| 9 mm | 1776 | 1828 | 1744 |
| | Avg. 1695 | Max. 1828 | Min. 1620 |

In another embodiment of the invention, an extremely lightweight ballistic vest was produced which met certification standards for NIJ Threat Level II and IIA with an areal weight of the entire ballistic sandwich less than about one pound per square foot. In one embodiment a ballistic vest meeting Threat Level IIA specifications had an areal weight of less than 0.9 pounds per square foot.

The extremely lightweight vests were made from the same materials as the front and rear ballistic panel sections 38 and 42 described previously. Thus, the ballistic vest comprised a flexible front panel section on the strike side comprised of a plurality of the overlying first flexible layers 34 arranged in a stack and secured to each other by quilt stitching to form a soft, flexible, woven front panel section 38 of unitary structure. The front panel section included the one-inch quilt pattern of individual layers comprised of the 35 gm/denier fiber and the 32×32 weave pattern The panel also included the overlying second flexible layers 40 arranged in a stack on the body side of the ballistic vest where each second flexible layer comprised a thin, flexible, imperforate plastic sheet comprised of the high tensile strength plastic fibers embedded in a resinous matrix to form the thin flexible plastic sheet described previously. The second layers 40 were stacked behind the front panel section 38 so they are free-floating and are freely movable relative to one another within the vest without being laminated to each other or otherwise bonded to one another in a face-to-face relation, thus forming the rear panel section 42 of the vest. The examples to follow describe the progression of development of the extremely lightweight ballistic vests that meet Threat Level II and IIA specifications.

EXAMPLE 5

An objective was to develop an extremely lightweight ballistic vest that meets NIJ Threat Level II test standards while having an areal weight of less than one pound per square foot (psf). Resistance to projectile penetration that meets NIJ Standard 0101.03 Certification Testing for Threat Level II involves use of a 9 mm 124 gram FMJ projectile fired at a velocity of at least 1,175 fps and a .357 Magnum 158 gram JSP projectile at 1,395 fps. Backface deformation test standards under NIJ Standard Threat Level II have a maximum allowable bfs of 44 mm for the .357 Magnum and 9 mm rounds. A test panel was constructed with 17 plies of the SPECTRA 1000 fabric on the strike side of the panel and 20 plies of the SPECTRA SHIELD material on the rear side of the panel. The 17 layers of SPECTRA fabric included the one-inch quilt pattern and the 32×32 weave pattern similar to the fabric layers described in previous examples. V-50 and abbreviated NIJ testing on the resulting vest indicated that it may function well as a good Level II vest, but the vest combination had an areal weight of 1.002 psf. The results of the test were as follows:

| 17 Fabric/20 Sheet | | | | | | |
|---|---|---|---|---|---|---|
| Regression Curve | | | | | | |
| | Velocity | | Backface | | Penetration | |
| Proj. | Max. | Min. | Avg. | Max. | # | % |
| .357 Mag | 1439 | 1411 | 38.2 | 35 | 0 | 0 |
| .357 Mag | 1474 | 1454 | 29.25 | 33 | 2 | 12.5 |
| .357 Mag | 1542 | 1504 | 48.8 | 55 | 8 | 50 |
| 9 mm | 1262 | 1221 | 25.1 | 27 | 0 | 0 |
| 9 mm | 1305 | 1282 | 26.8 | 30 | 0 | 0 |

| V-50 | | | |
|---|---|---|---|
| Proj. | V-50 | High Partial | Low Complete |
| 9 mm | 1525 | 1536 | 1513 |
| .357 Mag | 1544 | 1586 | 1526 |

EXAMPLE 6

A test panel was constructed of 20 layers of the one-inch quilted SPECTRA 1000 fabric on the strike side and 17 layers of the SPECTRA SHIELD material on the rear side of the panel. The resulting combination had an areal weight of 0.975 psf. Regression curve analysis and V-50 testing were performed, but the results shown below were less than the required minimum level of performance for Threat Level II:

| 20 Fabric/17 Sheet | | | | | |
|---|---|---|---|---|---|
| Abbreviated NIJ | | | | | |
| | Velocity | | Backface | | |
| Proj. | Max. | Min. | Avg. | Max. | Penetration |
| .357 Mag | 1434 | 1408 | 36 | | 0 |
| 9 mm | 1242 | 1184 | 31 | | 0 |

| V-50 | | | |
|---|---|---|---|
| Proj. | V-50 | High Partial | Low Complete |
| 9 mm | 1620 | 1729 | 1594 |
| .357 Mag | 1588 | 1670 | 1568 |

EXAMPLE 7

Two different sandwich configurations were tested. A first test panel comprised 22 plies of the one-inch quilted SPECTRA 1000 fabric and 16 plies of the Spectra SHIELD, in which the total combination at an areal weight of 0.988 psf. A second test panel comprised a sandwich of 16 plies of the fabric and 20 plies of the SPECTRA SHIELD, with an areal weight of 0.98 psf. As shown in the following test results, the first panel outperformed the second panel:

| V-50 Comparisons | | | |
|---|---|---|---|
| Proj. | V-50 | High Partial | Low Complete |
| 22 Fabric/16 Sheet | | | |
| .357 Mag | 1604 | 1619 | 1564 |
| 9 mm | 1525 | 1532 | 1508 |
| 20 Fabric/17 Sheet | | | |
| .357 Mag | 1481 | 1474 | 1490 |
| 9 mm | 1507 | 1510 | 1486 |

EXAMPLE 8

Regression curve analysis and V-50 testing were performed on the panel having the better performance in Example 7. The results shown below indicated that this combination may produce a viable Level II ballistic vest.

| 22 Fabric/16 Sheet | | | | | | |
|---|---|---|---|---|---|---|
| Regression Curve | | | | | | |
| | Velocity | | Backface | | Penetration | |
| Proj. | Max. | Min. | Avg. | Max. | # | % |
| .357 Mag | 1436 | 1409 | 28.9 | 34 | 0 | 0 |
| .357 Mag | 1520 | 1406 | 29.1 | 35 | 0 | 0 |
| .357 Mag | 1552 | 1512 | 44.1 | 51 | 2 | 12.5 |
| 9 mm | 1237 | 1180 | 28.1 | 32 | 0 | 0 |
| 9 mm | 1346 | 1308 | 30.4 | 32 | 0 | 0 |
| 9 mm | 1406 | 1373 | 33.9 | 38 | 0 | 0 |

| V-50 | | | |
|---|---|---|---|
| Proj. | V-50 | High Partial | Low Complete |
| .357 Mag | 1581 | 1620 | 1524 |
| 9 mm | 1503 | 1512 | 1488 |

EXAMPLE 9

Abbreviated NIJ and V-50 testing was performed on the vest of Example 8 and the results are shown below. Based on these results the panel was submitted for certification testing.

| Abbreviated NIJ | | | | | |
|---|---|---|---|---|---|
| | Velocity | | Backface | | |
| Proj. | Max. | Min. | Avg. | Max. | Penetration |
| .357 Mag | 1457 | 1410 | 37 | 35 | 0 |
| 9 mm | 1252 | 1193 | 30 | 27 | 0 |

| V-50 | | | |
|---|---|---|---|
| Proj. | V-50 | High Partial | Low Complete |
| .357 Mag | 1557 | 1557 | 1534 |
| 9 mm | 1605 | 1604 | 1599 |

EXAMPLE 10

Certification and V-50 testing were performed on the vest of Examples 8 and 9. The results shown below indicate a successful certification and the first known Level II vest that meets these certification standards with an areal weight (0.98 psf) of less than one psf.

| Certification | | | | | | |
|---|---|---|---|---|---|---|
| | Velocity | | Backface | | Penetration | |
| Proj. | Max. | Min. | Avg. | Max. | # | % |
| .357 Mag | 1450 | 1405 | 36 | 30 | 0 | 0 |
| 9 mm | 1231 | 1194 | 30 | 28 | 0 | 0 |

| V-50 | | | |
|---|---|---|---|
| Proj. | V-50 | High Partial | Low Complete |
| .357 Mag | 1673 | 1666 | 1605 |
| 9 mm | 1621 | 1705 | 1631 |

EXAMPLE 11

Following the successful certification test in Example 10 a further objective became that of producing a ballistic vest that meets NIJ Threat Level IIA standards while having an areal weight of less than 0.9 psf. Resistance to projectile penetration that meets NIJ Standard Certification Testing for Threat Level IIA involves a 9 mm 124 gram FMJ projectile fired at a velocity of 1,090 fps and a .357 Magnum 158 JSP projectile at 1,250 fps. Maximum allowable bfs is 44 mm for the .357 Magnum and 9 mm rounds. A test panel was produced using 22 plies of the same fabric and 10 plies of the same SPECTRA SHIELD material used in the previous examples. Thus, the 22 layers of fabric were quilted on one-inch centers and were on the strike side of the panel. The test panel had a total areal weight of 0.80 psf. The following regression curve and subsequent V-50 test data were inconclusive.

| 22 Fabric/10 Sheet | | | |
|---|---|---|---|
| Proj. | V-50 | High Partial | Low Complete |
| .357 Mag | 1444 | 1458 | 1423 |
| 9 mm | 1418 | 1430 | 1406 |

| Regression Curve | | | | | | |
|---|---|---|---|---|---|---|
| | Velocity | | Backface | | Penetration | |
| Proj. | Max. | Min. | Avg. | Max. | # | % |
| .357 Mag | 1294 | 1258 | 30.4 | 36 | 0 | 0 |
| .357 Mag | 1346 | 1322 | 31 | 38 | 0 | 0 |
| .357 Mag | 1386 | 1362 | 33.75 | 42 | 4 | 25 |
| 9 mm | 1194 | 1153 | 25 | 30 | 0 | 0 |
| 9 mm | 1258 | 1227 | 28 | 33 | 1 | 6.25 |
| 9 mm | 1300 | 1254 | 29 | 33 | 2 | 12.5 |

| V-50 | | | |
|---|---|---|---|
| Proj. | V-50 | High Partial | Low Complete |
| 9 mm | 1282 | 1350 | 1218 |
| .357 Mag | 1441 | 1448 | 1428 |

EXAMPLE 12

A comparative test was conducted between a first panel comprising 22 plies of the same quilted Spectra 1000 fabric and 10 plies of SPECTRA SHIELD and a second panel comprising 16 plies of the fabric and 15 plies of SPECTRA SHIELD. The test panels had an areal weight of 0.80 and 0.81 psf, respectively. The second test panel (the 16/15 configuration) had the better performance as shown below. However, even though performance was better, it was still not high enough to meet Threat Level IIA standards.

| V-50 | | | |
|---|---|---|---|
| Proj. | V-50 | High Partial | Low Complete |
| 22 Fabric/10 Sheet | | | |
| 9 mm | 1293 | 1304 | 1258 |
| 9 mm | 1339 | 1364 | 1346 |
| 16 Fabric/15 Sheet | | | |
| 9 mm | 1371 | 1415 | 1292 |
| .357 Mag | 1451 | 1459 | 1448 |

EXAMPLE 13

One additional layer of the SPECTRA SHIELD sheet material was added to the panel having the 16/15 configuration of Example 12. The resulting panel having the 16/16 configuration had an areal weight of 0.855 psf. This test panel was subjected to regression curve and V-50 testing and the results shown below indicated that this was a viable combination for subsequent NIJ Level IIA certification testing.

| 16 Fabric/16 Sheet | | | | | | |
|---|---|---|---|---|---|---|
| Regression Curve | | | | | | |
| | Velocity | | Backface | | Penetration | |
| Proj. | Max. | Min. | Avg. | Max. | # | % |
| .357 Mag | 1374 | 1265 | 29.3 | 37 | 0 | 0 |
| .357 Mag | 1413 | 1316 | 33.3 | 37 | 0 | 0 |
| .357 Mag | 1508 | 1458 | 34 | 40 | 10 | 60 |
| 9 mm | 1222 | 1134 | 26 | 30 | 0 | 0 |
| 9 mm | 1261 | 1205 | 30 | 33 | 1 | 6.25 |
| 9 mm | 1372 | 1312 | 32 | 38 | 1 | 6.25 |

| V-50 | | | |
|---|---|---|---|
| Proj. | V-50 | High Partial | Low Complete |
| 9 mm | 1441 | 1470 | 1410 |
| .357 Mag | 1501 | 1540 | 1494 |

EXAMPLE 14

Abbreviated NIJ Level IIA and V-50 testing on the 16/16 configuration of Example 13 was conducted. The following results were positive and based on these results the panel was submitted for certification testing.

| Abbreviated NIJ | | | | | |
|---|---|---|---|---|---|
| | Velocity | | Backface | | |
| Proj. | Max. | Min. | Avg. | Max. | Penetration |
| .357 Mag | 1292 | 1273 | 37 | 33 | 0 |
| 9 mm | 1160 | | | | 0 |

-continued

| | V-50 | | |
|---|---|---|---|
| Proj. | V-50 | High Partial | Low Complete |
| 9 mm | 1549 | 1596 | 1470 |
| .357 Mag | 1565 | 1619 | 1484 |

EXAMPLE 15

NIJ certification and V-50 testing were performed on the panel consisting of 16 plies of the fabric on the strike side and 16 plies of Spectra Shield on the body side, with an areal weight of 0.855 psf. The following results show that certification was successful in meeting Level IIA standards.

| | Certification | | | | |
|---|---|---|---|---|---|
| | Velocity | | Backface | | |
| Proj. | Max. | Min. | Avg. | Max. | Penetration |
| .357 Mag | 1296 | 1270 | 38 | 31 | 0 |
| 9 mm | 1151 | 1114 | 29 | 27 | 0 |

| | V-50 | | |
|---|---|---|---|
| Proj. | V-50 | High Partial | Low Complete |
| 9 mm | 1501 | 1523 | 1466 |
| .357 Mag | 1578 | 1619 | 1490 |

What is claimed is:

1. A ballistic vest of the soft body armor type comprising:

a composite protective panel having ballistic resistance and consisting essentially of a first flexible panel and a second flexible panel, the composite panel having a strike side and a body side, the first flexible panel comprising a first group of flexible woven fabric layers arranged in a stack in face-to-face surface contact on the strike side of the composite panel, each first woven fabric layer comprising an array of woven plastic fibers, the individual first woven fabric layers being secured to each other to form a flexible unitary panel, the second flexible panel comprising a second group of flexible imperforate plastic sheets arranged in a stack in face-to-face surface contact on the body side of the composite panel, each second flexible imperforate plastic sheet comprising an array of plastic fibers embedded in a resinous matrix-type film, in which the plastic fibers in the first woven fabric layers and the second imperforate plastic sheets comprise extended chain polyethylene fibers having a fiber tenacity of at least about 30 gm/denier, the ballistic resistance of the composite panel being provided essentially in its entirety from the strike side of the composite panel through the first flexible panel directly through the second flexible panel to the body side of the composite panel, the first and second flexible panels having a combined areal weight not greater than about 1.20 lbs/ft$^2$ and having an NIJ Standard maximum backface of about 44 mm (.44 Magnum), with a ballistic resistance that prevents projectile penetration of the combined first and second flexible panels according to NIJ Standard 101.03 for Threat Level IIIA.

2. Apparatus according to claim 1 in which the fibers of the first flexible layer are secured together by quilt stitching.

3. Apparatus according to claim 2 comprising an approximately one-inch quilt pattern.

4. Apparatus according to claim 1 in which the second sheet has an areal density of about 4.5 oz/yd$^2$.

5. Apparatus according to claim 1 in which the first flexible layer is made of extended chain polyethylene fibers having a module of at least about 1000 gm/denier.

6. Apparatus according to claim 1 in which the woven fibers are on a 32×32 weave pattern.

7. Apparatus according to claim 1 in which the vest has approximately 20 sheets of the first flexible layers and approximately 23 sheets of the second flexible layers.

8. A two-component ballistic vest of the soft body armor type comprising:

a composite protective panel having ballistic resistance consisting essentially of a first flexible sub-panel and a second flexible sub-panel, the composite protective panel having a strike side and a body side, the first flexible sub-panel comprising a first group of flexible woven fabric layers arranged in a stack in face-to-face surface contact on the strike side of the composite protective panel, each first woven fabric layer comprising an array of woven plastic fibers, the individual first woven fabric layers being secured to each other to form a flexible unitary sub-panel, the second flexible sub-panel comprising a second group of flexible imperforate plastic sheets arranged in a stack in face-to-face surface contact on the body side of the composite protective panel, each second imperforate plastic sheet comprising an array of non-woven plastic fibers embedded in a resinous matrix-type film, in which the plastic fibers in the first woven fabric layers and in the second imperforate plastic sheets comprise ultra high molecular weight high tensile strength ballistic resistant polymeric fibers, the ballistic resistance of the composite protective panel being provided essentially in its entirety from the strike side of the composite protective panel through the first flexible sub-panel directly through the second flexible sub-panel to the body side of the composite protective panel, the first and second flexible sub-panels having a combined areal weight not greater than about 1.20 lbs/ft$^2$ and having an NIJ Standard maximum backface of about 44 mm (.44 Magnum), with a ballistic resistance that prevents projectile penetration of the combined first and second flexible sub-panels according to NIJ Standard 0101.03 for Threat Level IIIA.

9. Apparatus according to claim 8 in which the fibers of the first flexible layer are secured together by quilt stitching.

10. Apparatus according to claim 8 in which the first and second stacks of flexible layers are secured to each other by a short line of stitching.

11. Apparatus according to claim 8 in which the fibers and the first layer are on a 32×32 weave pattern.

12. Apparatus according to claim 8 in which the vest has about 20 of the first layers and about 23 of the second layers.

13. Apparatus according to claim 8 in which the first woven fabric layers are quilted.

14. A ballistic vest of the soft body armor type comprising:

a composite protective panel having ballistic resistance consisting essentially of a first flexible panel and a second flexible panel, the composite panel having a strike side and a body side, the first flexible panel comprising a first group of flexible woven fabric layers arranged in a stack in face-to-face surface contact on the strike side of the composite panel, each first layer comprising an array of woven plastic fibers, the individual first woven fabric layers being secured to each other to form a flexible unitary panel, the second flexible panel comprising a second group of flexible imperforate plastic sheets arranged in a stack in fact-to-face surface contact on the body side of the vest, each second flexible imperforate sheet comprising an array of plastic fibers embedded in a resinous matrix-type film, in which the plastic fibers in the first woven fabric layers and the second imperforate plastic sheets comprise extended chain polyethylene fibers in which the fiber tenacity is at least about 30 gm/denier, essentially the entire ballistic resistance of the composite panel being provided from the strike side of the composite panel through the first flexible panel directly through the second flexible panel and to the body side of the composite panel, with the first and second flexible panels having a combined areal weight not greater than about one lb/ft$^2$ and having an NIJ Standard maximum backface of about 44 mm (.44 Magnum), with a ballistic resistance that prevents projectile penetration of the combined first and second flexible panels according to NIJ Standard Threat Level II.

15. Apparatus according to claim 14 in which the first flexible layer is made of extended chain polyethylene fibers having a modulus of at least about 1,000 gm/denier.

16. Apparatus according to claim 14 in which the woven fibers are on a 32×32 weave pattern.

17. Apparatus according to claim 14 in which the vest has approximately 22 sheets of the first flexible layers and 16 sheets of the second flexible layers.

18. A ballistic vest of the soft body armor type comprising:

a composite protective panel having ballistic resistance consisting essentially of a first flexible panel and a second flexible panel, the composite panel having strike side and a body side, the first flexible panel comprising a first group of flexible woven fabric layers arranged in a stack in face-to-face surface contact on the strike side of the composite panel, each first flexible woven fabric layer comprising an array of woven plastic fibers, the individual woven fabric layers being secured to each other to form a flexible unitary panel, the second flexible panel comprising a second group of flexible imperforate plastic sheets arranged in a stack in face-to-face surface contact on the body side of the composite panel, each second flexible layer comprising a thin flexible imperforate plastic sheet comprising an array of plastic fibers embedded in a resinous matrix-type film, in which the plastic fibers in the first flexible layer and the second flexible layer comprise extended chain polyethylene fibers with a fiber tenacity of at least about 30 gm/denier, the ballistic resistance of the composite panel being provided essentially in its entirely from the strike side of the composite panel through the first flexible panel directly through the second flexible panel and to the body side of the composite panel, with the first and second flexible panels having a combined areal weight not greater than about 0.90 lb/ft$^2$ and having an NIJ Standard maximum backface of about 44 mm (.44 Magnum), with a ballistic resistance that prevents projectile penetration of the combined first and second flexible panels according to NIJ Standard for Threat Level IIA.

19. Apparatus according to claim 18 in which the first flexible layer is made of extended chain polyethylene fibers having a modulus of at least about 1,000 gm/denier.

20. Apparatus according to claim 18 in which the woven fibers are on a 32×32 weave pattern.

21. Apparatus according to claim 18 in which the vest has about 16 of the first layers and about 16 of the second layers.

22. A two-component ballistic vest of the soft body armor type comprising:

a composite protective panel having ballistic resistance consisting essentially of a first flexible sub-panel and a second flexible sub-panel, the composite panel having a strike side and a body side, the first flexible sub-panel comprising a first group of flexible woven fabric layers arranged in a stack in face-to-face surface contact on the strike side of the composite protective panel, each first woven fabric layer comprising an array of woven plastic fibers, the individual first woven fabric layers being secured to each other to form a flexible unitary sub-panel, the second flexible sub-panel comprising a second group of flexible imperforate plastic sheets arranged in a stack in face-to-face surface contact on the body side of the composite protective panel, each second flexible imperforate sheet comprising an array of non-woven plastic fibers embedded in a resinous matrix-type film, in which the plastic fibers in the first woven fabric layers and in the second imperforate plastic sheets comprise ultra high molecular weight high tensile strength ballistic resistant polymeric fibers, essentially the entire ballistic resistance of the composite protective panel being provided from the strike side of the composite protective panel through the first flexible sub-panel directly through the second flexible ballistic sub-panel and to the body side of the composite protective panel, with the first and second flexible sub-panels having a combined areal weight not greater than about one lb/ft$^2$ and having an NIJ Standard maximum backface of about 44 mm (.44 Magnum), with a ballistic resistance that prevents projectile penetration of the combined of first and second flexible sub-panels according to NIJ Standard Threat Level II.

23. Apparatus according to claim 22 in which the first woven fabric layers are quilted.

24. A two-component ballistic vest of the soft body armor type comprising:

a composite protective panel having ballistic resistance consisting essentially of a first flexible sub-panel and a second flexible sub-panel, the composite protective panel having strike side and a body side, the first flexible sub-panel comprising a first group of flexible woven fabric layers arranged in a stack in face-to-face surface contact on the strike side of the composite protective panel, each first flexible woven fabric layer comprising an array of woven plastic fibers, the individual first woven fabric layers being secured to each other to form a flexible unitary sub-panel, the second flexible panel comprising a second group of flexible imperforate plastic sheets arranged in a stack in face-to-face surface contact on the body side of the composite protective panel, each second flexible layer comprising an array of non-woven plastic fibers embedded in a resinous matrix-type film, in which the plastic fibers in the first woven fabric layers and in the second imperforate plastic sheets comprise ultra high molecular weight high tensile strength ballistic resistant polymeric fibers, the ballistic resistance of the composite protective panel being provided essentially in its entirety from the strike side of the composite protective panel through the first flexible sub-panel directly through the second flexible sub-panel and to the body side of the composite protective panel with the first and second flexible sub-panels having a combined areal weight not greater than about 0.90 $lb/ft^2$ and having an NIJ Standard maximum backface of about 44 mm (.44 Magnum), with a ballistic resistance that prevents projectile penetration of the combined first and second flexible sub-panels according to NIJ Standard for Threat Level IIA.

25. Apparatus according to claim 24 in which the first woven fabric layers are quilted.

* * * * *

UNITED STATES PATENT AND TRADEMARK OFFICE

CERTIFICATE OF CORRECTION

PATENT NO. : 5,619,748
DATED : April 15, 1997
INVENTOR(S) : Jeff S. Nelson; Allen L. Price It is certified that error appears in the above-indentified patent and that said Letters Patent is hereby corrected as shown below:

Column 1, line 25, change "KELVAR" to -- KEVLAR --.
Column 2, line 30, after "an" delete "These and".
Column 2, line 58, change "root" to -- foot --.
Column 4, line 44, change "ward" to -- warp --.
Column 10, line 1, change "Spectra" to -- SPECTRA --.

Signed and Sealed this

Twenty-first Day of October 1997

*Attest:*

Bruce Lehman

BRUCE LEHMAN

*Attesting Officer*

*Commissioner of Patents and Trademarks*